US010694585B2

(12) United States Patent
Holoubek et al.

(10) Patent No.: US 10,694,585 B2
(45) Date of Patent: Jun. 23, 2020

(54) PLANAR HEATING ELEMENT WITH A PTC RESISTIVE STRUCTURE

(71) Applicant: Innovative Sensor Technology IST AG, Ebnat-Kappel (CH)

(72) Inventors: Jiri Holoubek, Wattwil (CH); Mirko Lehmann, Ebnat-Kappel (CH); Josef Vlk, Chanovice (CZ)

(73) Assignee: Innovative Sensor Technology IST IG, Ebnat-Kappel (CH)

( * ) Notice: Subject to any disclaimer, the term of this patent is extended or adjusted under 35 U.S.C. 154(b) by 591 days.

(21) Appl. No.: 15/316,583

(22) PCT Filed: Jun. 12, 2015

(86) PCT No.: PCT/EP2015/063165

§ 371 (c)(1),
(2) Date: Dec. 6, 2016

(87) PCT Pub. No.: WO2015/189388

PCT Pub. Date: Dec. 17, 2015

(65) Prior Publication Data

US 2018/0152989 A1 May 31, 2018

(30) Foreign Application Priority Data

Jun. 13, 2014 (DE) ..... 10 2014 108 356

(51) Int. Cl.
*H05B 3/20* (2006.01)
*H05B 3/00* (2006.01)
*H05B 3/14* (2006.01)

(52) U.S. Cl.
CPC ..... *H05B 3/20* (2013.01); *H05B 3/0014* (2013.01); *H05B 3/141* (2013.01);
(Continued)

(58) Field of Classification Search
CPC ..... H05B 3/16; H05B 3/20; H05B 3/0014; H05B 3/141; H05B 2203/003;
(Continued)

(56) References Cited

U.S. PATENT DOCUMENTS 4,849,611 A * 7/1989 Whitney ..... H05B 3/141 219/538
4,970,376 A 11/1990 Mellor et al.
(Continued)

FOREIGN PATENT DOCUMENTS

CN 1947462 A 4/2007
CN 102970780 A 3/2013
(Continued)

OTHER PUBLICATIONS

Machine Translation of DE 19523301—Gerblinger, Jan. 1997 (Year: 2019).*
(Continued)

*Primary Examiner* — Brian W Jennison
(74) *Attorney, Agent, or Firm* — Christopher R. Powers; PatServe

(57) ABSTRACT

The invention relates to a planar heating element (1) comprising a PTC resistive structure (2), which is arranged in a defined surface region (3) of a first surface (4) of a support substrate (5), wherein electrical connection contacts (6) for connection to an electrical voltage source (7) are associated with the PTC resistive structure (2), wherein the PTC resistive structure (2)—starting from the two electrical connection contacts (6)—has at least one internal conductive trace (8) and a parallel connected, external conductive trace (9), wherein the internal conductive trace (8) has a greater resistance than the external conductive trace (9) and wherein the resistances of the internal conductive trace (8) and external conductive trace (9) are so sized that upon applying
(Continued)

a voltage an essentially uniform temperature distribution is present within the defined surface region (3).

38 Claims, 3 Drawing Sheets

(52) U.S. Cl.
CPC .. *H05B 2203/003* (2013.01); *H05B 2203/007* (2013.01); *H05B 2203/016* (2013.01); *H05B 2203/017* (2013.01); *H05B 2203/02* (2013.01)

(58) Field of Classification Search
CPC ..... H05B 2203/007; H05B 2203/016; H05B 2203/017; H05B 2203/02
See application file for complete search history.

(56) References Cited

U.S. PATENT DOCUMENTS

| | | | | |
|---|---|---|---|---|
| 5,998,049 | A * | 12/1999 | Tanaka | C22C 29/00 219/541 |
| 6,008,479 | A * | 12/1999 | Jiang | H01K 1/04 219/270 |
| 2012/0201582 | A1* | 8/2012 | Shimura | H05B 3/0095 399/329 |
| 2013/0048627 | A1* | 2/2013 | Satou | H05B 3/06 219/552 |

FOREIGN PATENT DOCUMENTS

| | | | |
|---|---|---|---|
| CN | 103443620 | A | 12/2013 |
| DE | 19523301 | A1 | 1/1997 |
| DE | 10 108662 | A1 | 8/2001 |
| DE | 10314010 | A1 | 10/2004 |
| DE | 102005057566 | A1 | 6/2007 |
| DE | 102008007664 | A1 | 8/2009 |
| DE | 102010063529 | A1 | 6/2012 |
| DE | 102014108356 | A1 | 12/2015 |
| EP | 0905494 | A2 | 3/1999 |
| EP | 1048935 | A2 | 11/2000 |
| EP | 1189281 | A2 | 3/2002 |
| EP | 1801548 | A2 | 6/2007 |
| JP | 62046657 | A | 2/1987 |
| JP | 5029067 | B2 | 9/2008 |
| JP | 2009-517676 | A | 4/2009 |
| JP | 201351069 | A | 3/2013 |
| RU | 109536 | U1 | 10/2011 |
| WO | 2007/62969 | A1 | 6/2007 |
| WO | WO2007062969 | A1 | 6/2007 |
| WO | 2009016013 | A1 | 2/2009 |
| WO | WO2011078063 | A1 | 6/2011 |
| WO | WO2012084343 | A1 | 6/2012 |

OTHER PUBLICATIONS

International Search Report, EPO, The Netherlands—dated Jul. 31, 2015.
English Translation of the International Preliminary Report on Patentability, WIPO, Geneva, CH,—dated Dec. 22, 2016.
Chinese Office Action in corresponding Chinese Application No. 201580031598.3, dated Jan. 3, 2019.
European Search Report in corresponding European Application No. 15728852.3, dated Feb. 5, 2019.

* cited by examiner

PLANAR HEATING ELEMENT WITH A PTC RESISTIVE STRUCTURE

The invention relates to a planar heating element with a PTC resistive structure, which is arranged in a defined surface region of a first surface of a support substrate, wherein electrical connection contacts for connection to an electrical voltage source are associated with the PTC resistive structure. Furthermore, the invention relates to a heating apparatus, in which the planar heating element of the invention is applied. Furthermore, the invention relates to preferred uses of the heating element of the invention, respectively the heating apparatus of the invention. Moreover, the invention relates to a method for manufacturing the heating element of the invention.

Known from the state of the art is, for example, to determine, respectively monitor, temperature by evaluating the electrical resistance of a resistive structure. Corresponding resistive structures are applied on a substrate either using thin film technology or thick film technology. Often, the resistive structures are meander shaped or spiral shaped.

Also known is to heat a surrounding medium to a predetermined temperature via corresponding resistive structures. For this, the resistive structure is connected with an electrical voltage source. For example, heatable resistive structures are applied in the case of thermal, flow measuring devices for determining and/or monitoring the mass flow of a medium through a measuring tube.

Resistive structures applied for temperature measurement and heatable resistive structures are usually manufactured of a PTC (Positive Temperature Coefficient) material, preferably nickel or platinum. PTC resistive structures are distinguished by the feature that the ohmic resistance increases with rising temperature, wherein the functional dependence is highly linear over a large temperature range.

A disadvantage of the known resistive structures, especially when they are meander shaped, lies in the relatively large resistance of these structures. As a result thereof, a relatively high voltage must be provided for energy supply. If, moreover, a uniform temperature distribution is required within a defined surface region, such is not implementable with a known meander structure. Such a structure has the disadvantage that it can have—caused by process fluctuations in the manufacture of the coatings—different line breadths. This leads to the forming of hot spots, since regions of smaller line breadth have higher resistance. This leads to locally increased heating (hotspots), which is amplified by the fact that the heating supplementally increases the resistance. On the other hand, such a solution has the result that high current densities can lead to electromigration.

An object of the invention is to provide a planar heating element, which has in a defined surface region, at least approximately, a homogeneous, respectively uniform, temperature distribution.

The object is achieved by features including that the PTC resistive structure has—starting from the two electrical connection contacts—at least one internal conductive trace and one parallel connected, external conductive trace, that the internal conductive trace has a greater resistance than the external conductive trace and that the resistances of the internal conductive trace and the external conductive trace are so sized that upon applying a voltage an essentially uniform temperature distribution is present within the defined surface region. In such case, the effect is utilized that the conductive trace with the smaller resistance provides a greater contribution to the heating power. Therefore, the parallel circuit of the two conductive traces has a stabilizing effect. If, namely, one of the two conductive traces has e.g. a process related narrowing, then, as a rule, no hotspot forms at such location.

Outside of the largely uniformly heated surface region, there is a high temperature gradient, so that the heated zone is essentially limited to the defined surface region. Small ohmic resistances can be implemented with the at least two parallel extending and parallel connected, conductive traces. Especially, the total resistance of the PTC resistive structure at room temperature without the heating voltage applied is preferably less than 3 ohm. Preferably, the PTC resistive structure is so embodied that it provides besides the heating function also temperature measured values, so that the PTC resistive structure serves as a heating element and as a temperature sensor.

In a first advantageous embodiment of the heating element of the invention, the internal conductive trace and the external conductive trace are manufactured of the same material; the different resistances are implemented via different cross sectional areas and/or lengths of the internal conductive trace and external conductive trace. This first embodiment has the advantage that the resistive structure is composed of a single material, so that the resistive structure can be built in one manufacturing step. Preferably used as material for the PTC resistive structure is nickel or platinum. Platinum has the advantage that it can also be applied without problem at high temperatures above 300° C.

In an alternative embodiment of the heating element of the invention, the internal conductive trace and external conductive trace are manufactured of different materials, wherein the two conductive traces have different specific resistances. Also via a combination of different materials of different specific resistances, a uniform temperature distribution can be achieved within a defined surface region. Best for this is a combination of first embodiment and alternative embodiment.

An advantageous form of embodiment of the heating element of the invention provides that the PTC resistive structure is structured—virtually—in three portions:

a first end portion, which adjoins the electrical contact connections/connecting lines, via which connection with the electrical voltage source occurs, a middle portion, which adjoins the first end portion, and a second end portion following on the middle portion.

Proved as advantageous is when the internal conductive trace and the external conductive trace extend essentially parallel in the middle portion. Preferably, the internal conductive trace and the external conductive trace also extend essentially parallel in the second end portion. In the first end portion, the internal conductive trace and the external conductive trace run toward one another and are, in each case, connected with one of the two electrical connection contacts. Preferably, the two conductive traces in the first end portion have thus a V-shape. If no abrupt changes occur in the geometry of the PTC resistive structure, then a high temperature stability can be achieved in the defined surface region. Especially, the forming of so-called hot spots is prevented.

Just as well, it is, however, also possible that the two conductive traces are connected with one another in the first end portion via a section extending at right angles to the two conductive traces.

Likewise, both the internal conductive trace as well as also the external conductive trace can have either a V shape or a rectangular shape in the second end portion. Also in the second end portion, the internal conductive trace and the external conductive trace extend essentially parallel to one another. An option is also to use another shape, for example, a semicircular shape. Furthermore, an option is to use in one of the two end portions a first shape, e.g. a rectangular shape, and to use in the other end portion a second shape deviating from the first shape, e.g. a V shape.

Furthermore, an advantageous embodiment provides that the resistance per unit length of the internal conductive trace and/or the resistance per unit length of the external conductive trace in the first end portion and/or in the second end portion are/is greater than the resistance per unit length of the internal conductive trace and/or the external conductive trace in the middle portion.

An advantageous further development of the heating element of the invention provides that at least one geometrical parameter of the internal conductive trace and/or the external conductive trace, such as line width and filling thickness, is so varied at least in one subsection of at least one portion that a locally occurring deviation from the uniform temperature distribution is at least approximately cancelled in the affected portion.

Preferably, the substrate is composed of a material having a thermal conductivity lying below a predetermined limit value, so that between the defined surface region with more uniform temperature distribution and the connection contacts a large thermal gradient occurs, which lies above a predetermined limit value, typically above 50° C./mm. In this way, it is assured that the heated 'hot' zone is essentially limited to the defined surface region and is thermally decoupled from the externally lying 'cold' zone. Preferably, a substrate material is used, whose thermal conductivity is less than 5 Watt/m·K. Preferably, the thermal conductivity is less than 3 Watt/m·K.

The defined surface region has a boundary essentially defined by the outer dimensions of the external conductive trace. This defined surface region is the so-called heated zone or hot zone, in which temperatures of at least 300° C. reign. The limiting of the heated zone to the region defined by the outer dimensions of the outwardly lying conductive trace is especially achieved by providing that the substrate material has a low thermal conductivity. Moreover, it has preferably a thickness of less than/equal to 1 mm.

In order to achieve the heat exchange between the heated zone and the cold zone, which lies usually at room temperature and in which the connection contacts are located, electrical connecting lines with a small filling density are provided. These are preferably manufactured of highly pure gold (gold fraction at least greater than 95%, preferably greater than 99%). The connection contacts are made of silver or a silver alloy.

The resistance of the PTC resistive structure lies at room temperature below 10Ω, preferably below 3Ω or even below 1Ω. This is achieved by selecting at least one suitable material (preferably platinum) and a suitable dimensioning of the corresponding conductive trace structure.

The substrate material is aluminum oxide, quartz glass or zirconium oxide. Preferably in connection with the invention, the substrate is zirconium oxide. The thickness of the support substrate is preferably less than 1 mm. Zirconium oxide has the following advantages: A low thermal conductivity (which is, however, sufficient, in order, in given cases, to even-out locally occurring hot spots), a high mechanical stability even in the case of small thicknesses and relative to thermal expansion an optimal matching to metal components of the heating element, especially when the conductive traces are platinum. This embodiment assures that the homogeneous temperature distribution is limited to the surface region defined by the external dimensions of the resistive structure. Externally of the PTC resistive structure, the temperature falls very rapidly as a result of the high temperature gradients. Preferably, the shape of the support substrate is matched to the shape of the PTC resistive structure. Especially, the substrate material is, consequently, embodied in the second end portion with V shape or rectangular shape. If the second end portion is V shaped—it thus has a point—, then the heating element can be inserted into a medium to be heated. An example of a chip arrangement with a point is disclosed in European Patent, EP 1 189 281 B1.

In an advantageous embodiment of the heating element of the invention, at least one essentially electrically insulating, separating layer preferably manufactured of glass is provided on or in the substrate. As mentioned above, the substrate is preferably manufactured of zirconium oxide. Zirconium oxide has—such as already described above—properties, which recommend it for use in the heating element of the invention. However, zirconium oxide has the disadvantage that it is conductive at temperatures above 200° C. The insertion of a separating layer suppresses the occurrence of the conductivity. Further information on this known solution can be found in European Patent, EP 1 801 548 A2.

Furthermore, the substrate has at least one passivating layer, which is preferably applied on the surface of the substrate. The passivating layer is composed preferably at least partially of the material of the separating layer. The passivating layer serves for protecting against mechanical, chemical and electrical influences. Preferably, the passivating layer is deposited on both surfaces of the heating element. In this way, a mechanical bending of the support substrate can be prevented. Especially, the material of the passivating layer can be a glass sealing layer. Further information on a passivating layer useful in connection with the present invention can be found in published international application, WO 2009/016013 A1.

As already mentioned above, the PTC resistive structure is preferably manufactured of a conductive material suitable for use at high temperatures. Preferably, the PTC resistive structure is composed of platinum. Platinum has the advantage that it has, besides its good temperature stability, a well defined, almost linear characteristic curve of resistance versus temperature and a very high electromigration resistance. Moreover, due to the PTC characteristic, an approximate self control of temperature can be achieved with a platinum resistive structure, when the resistive structure is connected to a virtually constant voltage source (e.g. a battery). Moreover, a PTC resistive structure of platinum is an industry standard for temperature measurement.

In an advantageous embodiment of the heating element of the invention, the electrical connection contacts are manufactured of a noble metal or a noble metal alloy, wherein the noble metal is preferably silver and in the case of the noble metal alloy preferably a silver alloy. Silver likewise enjoys recognition as an industrial standard and has the advantage that it is well solderable, respectively weldable. However, silver has the disadvantage that it diffuses into platinum at temperatures above 300° C. Therefore, in the case of use at high temperatures (above 250° C.), no direct connection between a platinum-resistive structure and silver connection contacts is possible. To be mentioned is that silver in practice is applied only as an alloy. This is because a certain fraction of palladium or here preferably a certain fraction of platinum block the mobility of the silver atoms and therewith prevents material migration.

In order to avoid the above described problem, electrical connecting lines are provided between the electrical connection contacts and the first end portion of the first resistive structure. These are likewise manufactured of a noble metal, preferably gold. Gold assures a stable transition to platinum up to 850° C., has good electrical conductivity and can be deposited in very pure, compact, thin layers.

In a preferred embodiment of the solution of the invention, both the connecting lines and the conductive traces in the first end portion of the PTC-resistive structure as well as also the connecting lines and the electrical connection contacts have a defined overlap. Overlapping assures a secure electrical contacting. In an advantageous embodiment of the heating element of the invention, it is provided that the length of the overlap between the connecting lines and the conductive traces in the first end portion of the PTC-resistive structure is greater than the separation between the inner conductive trace and the outer conductive trace.

Preferably, the depth of the overlap between the connecting lines and the conductive traces in the first end portion of the PTC resistive structure especially in the case of a linear or V shaped overlap is greater than 100 μm. Especially advantageous in connection with the invention is when the length and the depth of the overlap between the connecting lines and the conductive traces in the first end portion of the PTC resistive structure have a ratio of approximately greater than 5:1.

In order to assure that as a result of the overlap, especially between the connecting lines and the PTC resistive structure, no disturbances occur in the area of the dimensions of the heated zone defined by the dimensions of the PTC resistive structure, the first end portion of the PTC resistive structure is so embodied as regards its geometric parameters that the physical heating properties of the PTC resistive structure are at least approximately unchanged. Preferably, the matching occurs by changes of the filling density or the line width of the conductive traces, respectively the connecting lines, in the vicinity of the respective overlaps.

As already mentioned above, the overlap between the connecting lines and the conductive traces in the first end portion of the PTC resistive structure is preferably V shaped or linear; it can, however, also be embodied strut shaped. The following are some preferred dimensions for the individual components of the heating element of the invention. The filling thickness of the conductive traces of the PTC resistive structure, which are preferably of platinum, lies between 5 and 10 μm, at least in the first end portion. The filling thickness of the connecting lines, which are preferably of gold, lies preferably between 3 and 10 μm. The thickness of the connection contacts, which are preferably of silver or a silver alloy, lies preferably in the range, 10 to 30 μm. The longitudinal extension of the PTC resistive structure lies in the order of magnitude of a few millimeters, preferably in the range, 2-10 mm. Moreover, the resistance of the PTC resistive structure at room temperature without applied heating voltage lies preferably below 3Ω, preferably below 1Ω. Since the PTC resistive structure is very low ohm, it is possible to heat the PTC resistive structure to high temperature with a relatively small energy supply. A voltage source of a few volt, e.g. 3 volt, is sufficient for operating the heating element.

Preferred dimensions and materials of a planar heating element in thick film technology are as follows. The total length of the planar heating element amounts to 19 mm and the width 5 mm. The external conductive trace is, for instance, twice as broad as the internal conductive trace (e.g. 800 μm versus 400 μm). The substrate of zirconium oxide has a thickness of 0.3 mm. The separating layer and the passivating layer each have a thickness of 15 μm and are arranged on both surfaces of the planar heating element. Of course, also other dimensions and materials can be selected by a technically qualified person. This planar heating element can easily achieve a temperature of 450° C.

The planar heating element of the invention can be produced in thin- or thick film technology. Preferably, it is manufactured in thick film technology due to the more cost effective manufacturing processes. The heating element of the invention is distinguished by a high dynamic range. After turn-on, the operating temperature is reached very rapidly; after turn-off, the planar heating element cools very rapidly to the surrounding room temperature.

The temperature in the defined surface region lies with an essentially uniform temperature distribution preferably in a temperature range between 300° C. and 750° C. Of course, depending on embodiment and materials used for the heating element of the invention, also temperatures outside of the above specified range can be covered.

Regarding choice of material, especially the following points are to be noted:

The two following effects must be balanced:

- An as high as possible thermal conductivity of the PTC resistive structure minimizes the thermal effects of power loss as a result of voltage drops on the conductive traces and lines.
- The thermal conductivity of the conductive traces must be relatively small, in order to prevent undesired heat removal from the heated zone.
- The electrical conductivity must, however, remain sufficiently high, in order to keep the production of additional heat through power loss in this region within limits.

An overlapping of the two conductive traces, which are preferably of platinum, with the preferably gold connecting lines is necessary, in order to assure a secure electrical contacting. In the region of the overlap (Pt/Au), the requirements, which are placed on the pure metal (e.g. Au and Pt) components of the heating element, are not fulfilled. These worsened properties in the regions of the overlap must be taken into consideration in the design of the PTC resistive structure. The ideal choice of geometry for the overlap is to have the highest possible length coupled with as small as possible depth of the overlap. Consequently, the V shape is especially suitable. Preferably, the depth of the overlap amounts to 100 μm. In general, the depth of the overlap is to be chosen such that it is reproducible in the manufacturing process. A small depth can also have disadvantages, when such varies e.g. between 25 μm and 30 μm. In the case of a small depth, the influence of a manufacturing process related error, e.g. of 5 μm, on the total performance is naturally greater than when 100 μm is used for the depth of the overlap.

The same ideas hold also in the region of the overlap (Ag/Au) of connection contacts (e.g. Ag) and connecting lines (e.g. Au). Since the temperatures arising at this overlap lie essentially lower (4 cold zone: the temperature corresponds essentially to the reigning ambient temperature) than in the region of the overlap of connecting lines and conductive traces (hot zone or heated zone: the temperature corresponds to the temperature in the defined region of the PTC resistive structure, thus the temperature of the heated zone), the properties of the PTC resistive structure are less strongly influenced.

Furthermore, the invention relates to a heating apparatus, which uses the above described PTC resistive structure in any suitable embodiment. Provided for this, besides the heating element of the invention, are an electrical voltage supply, which supplies the PTC resistive structure with energy, and a control/evaluation unit, which controls the PTC resistive structure to a predetermined temperature value.

The electrical voltage supply is a voltage source, which has a limited energy supply. Preferably, the electrical voltage is delivered by a battery.

Moreover, it is proposed in connection with the heating apparatus of the invention that a separate resistive structure is provided for determining the temperature of the medium heated by the heating element. Preferably, the resistive structure for temperature measurement and for heating is applied on the second surface of the support substrate lying opposite the first surface, on which the PTC resistive structure is arranged. Preferably the temperature control is performed based on the measured temperature, and heating is from both surfaces.

Preferably, the planar heating element of the invention, respectively the heating apparatus of the invention, is applied in a semiconductor based, compact gas sensor, in a compact heater for handheld devices or in a calorimetric flow sensor.

Located on the passivating layer can be e.g. a gas sensitive structure, e.g. a metal oxide and an interdigital electrode structure. The invention can therefore also serve generally as a basis for sensors, in the case of which heating is essential for the sensor function.

The planar heating element of the invention is preferably manufactured via the method described as follows:

Applied on each of the two surfaces of the support substrate—usually one after the other—is a separating layer. It is usual, when thick film technology is used, to print the coatings. As already mentioned above, it is possible, however, also to use thin film technology in connection with the invention. Applied on one of the two dry separating layers is the PTC resistive structure. As soon as the PTC resistive structure is hardened, the electrical connecting lines are applied and exposed to a drying process. Then, the connection contacts are applied and likewise hardened. Preferably, the overlapping regions of the connection contacts and electrical connecting lines are again separately hardened. Applied and hardened on the two surfaces of the planar heating element—preferably successively—are the passivating layers.

BRIEF DESCRIPTION OF THE DRAWINGS

The invention will now be explained in greater detail based on the appended drawing, the figures of which show as follows.

DETAILED DISCUSSION IN CONJUNCTION WITH THE DRAWINGS

Figure 1:
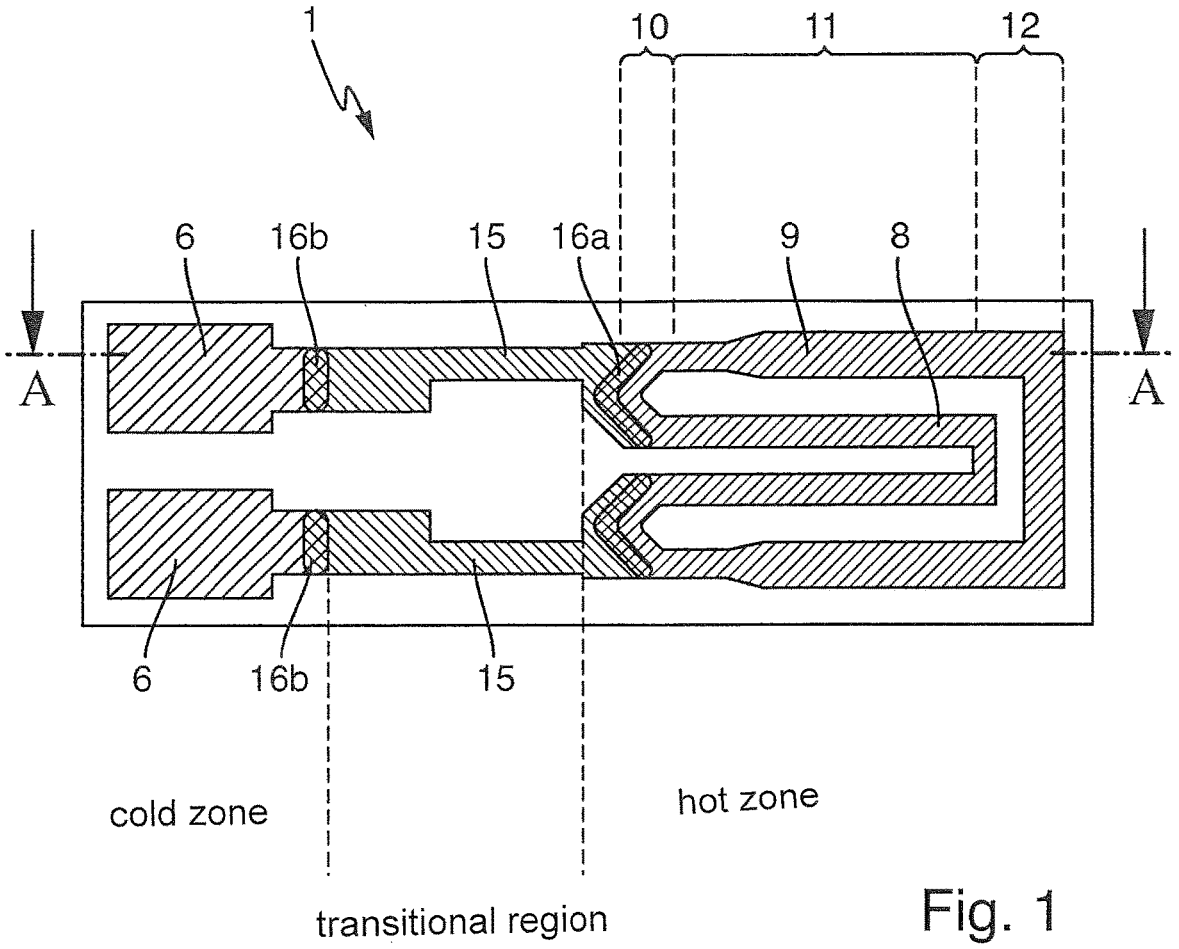
FIG. 1 is a plan view of a preferred embodiment of the heating element of the invention.

FIG. 1 shows a plan view of a preferred embodiment of the heating element 1 of the invention. The external dimensions of the PTC resistive structure 2 limit the defined surface region 3, respectively the heated zone. The PTC resistive structure is virtually divided into three different portions: A first end portion 10, which adjoins the connection contacts 6, respectively the electrical connecting lines 15, a middle portion 11, which adjoins the first end portion 10, and a second end portion 12, which adjoins the middle portion 11. Between the connection contacts 6 and the electrical connecting lines 15, there is an overlap 16*b* of defined length. Likewise, there is between each connecting line 15 and the conductive traces 8, 9 an overlap 16*a*.

The internal conductive trace 8 and the external conductive trace 9 of the PTC resistive structure 2 extend approximately parallel and are connected electrically in parallel. The internal conductive trace 8 has a greater resistance than the external conductive trace 9. The resistances of the internal conductive trace 8 and external conductive trace 9 are so sized that upon applying a voltage an essentially uniform temperature distribution is present within the defined surface region 3. This defined surface region is also referred to as the heated zone and is indicated in FIG. 1 by the dashed line on the outer edge of the PTC resistive structure 2.

The cold zone, thus the region, where essentially room temperature reigns, lies in the region of the connection contacts 6. In the transitional region lying between the heated zone and the cold zone, same as in the outer region of the defined surface region 3, the temperature gradient is very high. As a result of the high temperature gradient, the heated zone is largely limited to the defined surface region 3. The high temperature gradient is achieved by the choice of a support substrate 5 with low thermal conductivity. Other information in this regard is provided above.

In the case of the illustrated form of embodiment, the internal conductive trace 8 and the external conductive trace 9 are manufactured of the same material. As mentioned above, platinum is preferably used as material of the conductive traces 8, 9. The different resistances of the conductive traces 8, 9 are implemented via different cross sectional areas and/or lengths of the internal conductive trace 8 and external conductive trace 9.

A preferred dimensioning of the heating element of the invention, respectively of the chip of the invention, is given above.

Evident from FIG. 1 is that the connecting lines 15, which—as indicated above—are preferably of gold, likewise vary in width: following the first portion 10, the width is smaller and therewith the resistance greater than in the region, which adjoins the connection contacts 6. In this way, it is achieved that the thermal conductivity does not increase. In connection with the smaller thermal conductivity of gold compared with platinum, the desired large temperature gradient is achieved in the transitional region from the heated zone to the cold zone.

Figure 1A:
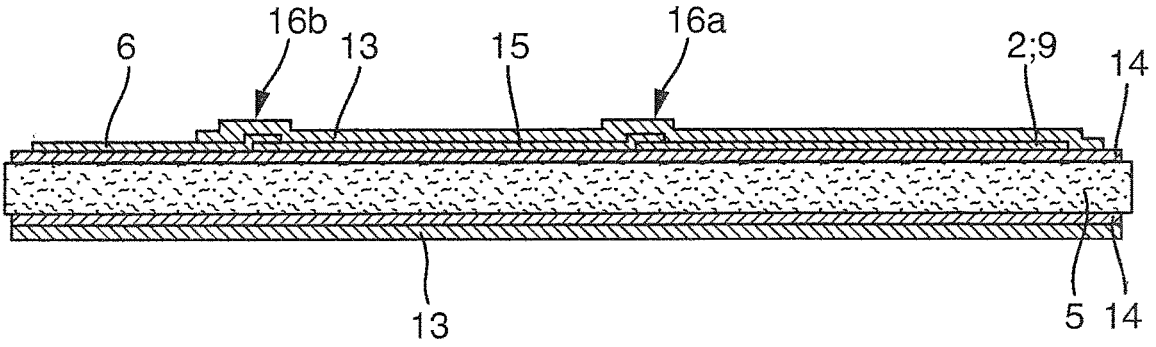
FIG. 1*a* is a longitudinal section taken according to the cutting plane A-A of the heating element of the invention shown in FIG. 1.

FIG. 1*a* shows a longitudinal section taken on the cutting plane A-A of the heating element 1 of the invention shown in FIG. 1. Arranged on both surfaces 4, 19 of a support substrate 5 is a separating layer 14. The substrate 5 is preferably zirconium oxide with a thickness of 300 μm, while the separating layers 14 have, in each case, a thickness of 15 μm. Applied on the separating layer 14 on the surface 4 of the support substrate 5 is the PTC resistive structure 2. The PTC resistive structure is composed of platinum with a thickness of 8 μm.

The above described dimensioning of the PTC resistive structure 2 is not limited to the mentioned values. Each of the explicitly mentioned values can be varied as much as desired upwardly or downwardly. How the dimensioning of the variants is embodied in detail lies within the skill of the art.

In the case of a preferred embodiment of the invention, the connection contacts 6 are manufactured of silver and have a thickness of 10 μm. The electrical connecting line 15 between the connection contacts 6 and the PTC resistive structure 2 are of gold and are 4 μm thick. In the region of the overlap 16*b*, the connection contacts 6 and the electrical connecting lines 15 overlap, while in the region of an overlap 16*a*, the electrical connecting lines 15 and the conductive traces 8, 9 of the PTC resistive structure overlap. The surfaces 4, 19 of the planar heating element 1 are sealed with a passivating layer 13. The passivating layer 13 has a thickness of 15 μm. The functions of the individual layers were explained above. The sensitivity of the planar heating element amounts at room temperature without applying the heating voltage to 3700 ppm/K (+−100 ppm/K). The thicknesses of the individual layers are given by way of example. Each of the explicitly mentioned values of the preferred embodiment can be varied upwardly or downwardly as much as desired. How the dimensioning is embodied in detail lies within the skill of the art.

Figure 2:
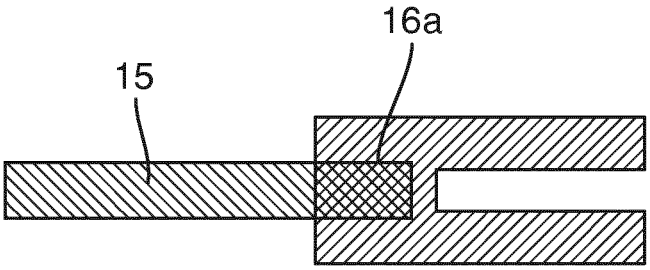
FIG. 2 is a schematic partial view of the heating element of the invention showing a first embodiment of the overlap between a connecting line and the conductive traces.
Figure 3:
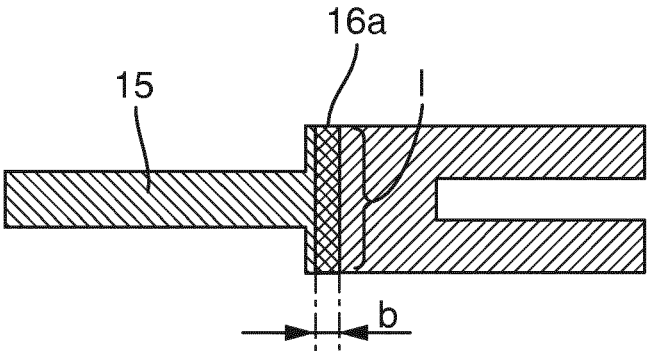
FIG. 3 is a schematic partial view of the heating element of the invention showing a second embodiment of the overlap between a connecting line and the conductive traces.
Figure 4:
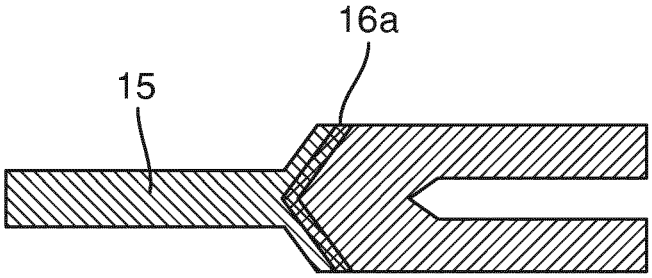
FIG. 4 is a schematic partial view of the heating element of the invention showing a third embodiment of the overlap between a connecting line and the conductive traces.

FIGS. 2, 3, and 4 show schematically partial views of the heating element of the inventions 1 with different embodiments of the overlap 16*a* between one of the connecting lines 15 and the connected conductive traces 8, 9. The overlap 16*a* in FIG. 2 has a strut shaped embodiment, the overlap 16*a* in FIG. 3 is rectangularly shaped and the overlap 16*a* in FIG. 4 has a V shape. The overlap 16*a* between the connecting lines 15 and the conductive traces 8, 9 in the first end portion 10 of the PTC resistive structure 2 is so embodied relative to its geometric parameters that the physical heating properties of the PTC resistive structure 2 are at least approximately unchanged, respectively are almost identical with the properties in the defined surface region 3 containing the heated zone. The materials and the special features, which occur in the regions of the overlap 16*a*, 16*b*, have been described above, so that a repetition here is omitted.

Figure 5A:
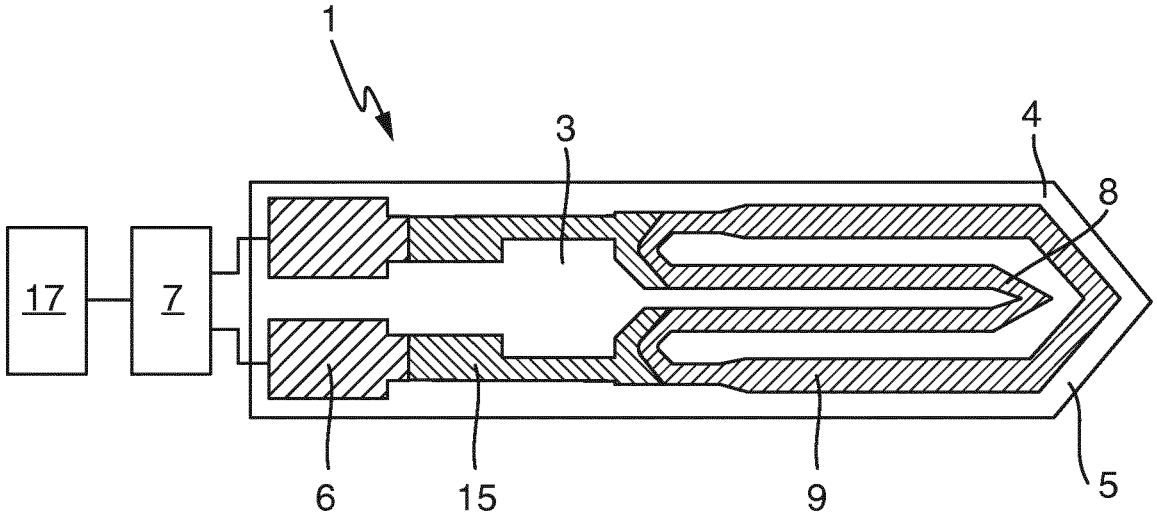
FIG. 5*a* is a plan view of a second embodiment of the heating element of the invention, with PTC resistive structure.
Figure 5B:
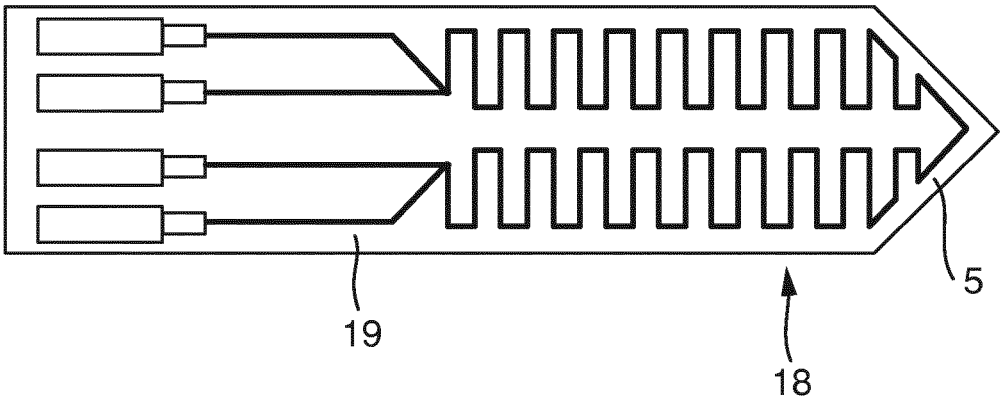
FIG. 5*b* is a plan view of the rear-side of the heating element shown in FIG. 5*a*.

FIG. 5*a* shows a plan view of a second embodiment of the heating element 1 of the invention with PTC resistive structure 2, while FIG. 5*b* shows a plan view of the rear side 19 of the heating element 1 shown in FIG. 5*a*. A meander shaped temperature sensor 18 is arranged on the rear side 19. Furthermore, FIG. 5*a* also shows schematically the heating apparatus of the invention with heating element 1, electrical voltage source 7 and control/evaluation unit 17.

The invention claimed is:

1. A planar heating element, comprising:

a support substrate;

a PTC resistive structure disposed in a surface region of said support substrate and including a first end portion, a middle portion, and a second end portion; and electrical connection contacts configured to connect an electrical voltage source with said PTC resistive structure, said electrical connection contacts connected to said PTC resistive structure via corresponding electrical connecting lines, wherein:

said PTC resistive structure includes an internal conductive trace and a parallel connected, external conductive trace, which extend substantially parallel to each other;

each of the internal conductor trace and the external conductor trace has a line width and a filling thickness, wherein the respective line widths of the internal conductor trace and external conductor trace additively define a filling density of the PTC resistive structure for a given portion of the surface region;

each of the internal conductor trace and the external conductor trace include overlapping areas with the corresponding connecting lines in said first end portion of said PTC resistive structure;

said internal conductive trace has a greater electrical resistance than said external conductive trace, the electrical resistances of said internal conductive trace and said external conductive trace being such that, upon applying a voltage, an essentially uniform temperature distribution is present within said surface region; and the filling density, filling thickness and/or the respective line widths of the internal conductor trace and external conductor trace at or near each respective overlapping area are configured such that the uniformity of the temperature distribution of said PTC resistive structure is at least approximately unchanged between said first end portion and said middle portion of the surface region.

2. The planar heating element as claimed in claim 1, wherein:

said PTC resistive structure is further configured to generate temperature measured values such that said PTC resistive structure functions as both a heating element and as a temperature sensor.

3. The planar heating element as claimed in claim 1, wherein:

said internal conductive trace and said external conductive trace are manufactured of the same material; and the different electrical resistances are implemented via different cross sectional areas and/or lengths of said internal conductive trace and said external conductive trace, respectively.

4. The planar heating element as claimed in claim 1, wherein:

said internal conductive trace and said external conductive trace are of different materials, which have different specific resistances.

5. The heating element as claimed in claim 1, wherein:

said internal conductive trace and said parallel connected, external conductive trace extend essentially parallel in said middle portion.

6. The heating element as claimed in claim 1, wherein:
said internal conductive trace and said external conductive trace extend toward one another in said first end portion and are connected with the corresponding electrical connection contacts.

7. The heating element as claimed in claim 1, wherein:
the resistance of said internal conductive trace and/or the resistance of said external conductive trace in said first end portion and/or in said second end portion is greater than the resistance of said internal conductive trace and/or said external conductive trace in said middle portion.

8. The heating element as claimed in claim 1, wherein:
at least one geometrical parameter, such as line width and filling thickness, of said internal conductive trace and/or said external conductive trace is so varied at least in one subsection of said at least one portion that a locally occurring deviation from the uniform temperature distribution is at least approximately cancelled in the affected portion.

9. The heating element as claimed in claim 1, wherein:
said substrate is composed of a material having a thermal conductivity lying below a predetermined limit value, so that between said heated defined surface region and said connection contacts a thermal gradient occurs, which lies above a predetermined limit value, preferably above 50° C./mm.

10. The heating element as claimed in claim 1, further comprising:
at least one essentially electrically insulating separating layer provided on or in said substrate.

11. The heating element as claimed in claim 1, wherein:
said substrate has at least one passivating layer, which is applied on the surface of said support substrate.

12. The heating element as claimed in claim 1, wherein:
said PTC resistive structure is composed of includes a conductive material suitable for use at high temperatures.

13. The heating element as claimed in claim 1, wherein:
said electrical connection contacts are manufactured of a noble metal or a noble metal alloy.

14. The heating element as claimed in claim 1, wherein:
said electrical connecting lines are provided between said electrical connection contacts and said first end portion of said PTC resistive structure, which are manufactured of a noble metal.

15. The heating element as claimed in claim 1, wherein:
said connecting lines and said conductive traces in said first end portion of said PTC resistive structure and said connecting lines and said electrical connection contacts each have defined overlaps.

16. The heating element as claimed in claim 15, wherein:
said overlap between said connecting lines and said conductive traces in said first end portion of said PTC resistive structure is so dimensioned that the uniformity of the temperature distribution of said PTC resistive structure is at least approximately unchanged.

17. The heating element as claimed in claim 15, wherein:
said overlap between said connecting lines and said conductive traces in said first end portion of said PTC resistive structure is embodied V-shaped, rectangularly shaped or strut shaped.

18. The heating element as claimed in claim 15, wherein:
the breadth of said overlap between said connecting lines and said conductive traces in said first end portion of said PTC resistive structure is greater than the separation between said internal conductive trace and said external conductive trace.

19. The heating element as claimed in claim 15, wherein:
a depth of said overlap between said connecting lines and said conductive traces in said first end portion of said PTC resistive structure in the case of a linear or V-shaped overlap is greater than 100 μm.

20. The heating element as claimed in claim 15, wherein:
a length and a depth of said overlap between said connecting lines and said conductive traces in said first end portion of said PTC resistive structure have a ratio of approximately greater than 5:1.

21. The heating element as claimed in claim 1, wherein:
the respective filling thicknesses the internal conductor trace and the external conductor trace of said PTC resistive structure lie between 5 and 10 μm, at least in said first end portion.

22. The heating element as claimed in claim 1, wherein:
a thickness of said connecting lines lies between 3 and 10 μm.

23. The heating element as claimed in claim 1, wherein:
a thickness of said connection contacts lies between 10 and 30 μm.

24. The heating element as claimed in claim 1, wherein:
the temperature in said defined surface region lies with an essentially uniform temperature distribution in a temperature range between 300° C. and 750° C.

25. The heating element as claimed in claim 1, wherein:
a total resistance of said PTC resistive structure at room temperature without applied heating voltage lies below 3Ω, preferably below 1Ω.

26. A heating apparatus comprising:
the heating element according to claim 1;
the electrical voltage source adapted to supply said PTC resistive structure with energy; and
a control/evaluation unit configured to control said PTC resistive structure to provide a predetermined temperature value in the surface region.

27. The heating apparatus as claimed in claim 26, wherein:
said electrical voltage source is a voltage source having a limited energy supply with a voltage less than or equal to 3 V.

28. The heating apparatus as claimed in claim 26, further comprising:
a resistive structure for determining temperature and for heating a medium, wherein said resistive structure is applied on a second surface of said support substrate lying opposite the surface region.

29. A method of heating a medium, the method comprising:
providing the heating apparatus according to claim 26, wherein the control/evaluation unit is configured to control the PTC resistive structure to a predetermined temperature value in a semiconductor-based, compact gas sensor, in a compact heater for handheld devices or in a calorimetric flow sensor; and
heating a medium adjacent the heating element in a semiconductor-based, compact gas sensor, in a compact heater for handheld devices or in a calorimetric flow sensor using the heating element.

30. A method for manufacturing a planar heating element, comprising: a support substrate; a PTC resistive structure, which is arranged in a defined surface region of said support substrate; and electrical connection contacts for connection to an electrical voltage source which are associated with said PTC resistive structure, wherein: said PTC resistive structure has at least one internal conductive trace and one parallel connected, external conductive trace; said internal conductive trace has a greater resistance than said external conductive trace; and the resistance of said internal conductive trace and said external conductive trace are so sized that upon applying a voltage, an essentially uniform temperature distribution is present within said defined surface region, the method comprising the steps as follows:

coating each of the surfaces of the support substrate with a separating layer;

applying the resistive structure on the separating layer of the surface;

applying the electrical connecting lines;

applying the connection contacts; and applying passivating layers in the region of both surfaces.

31. The method as claimed in claim 30, wherein:

the coating and applying are performed by thick film technology or thin film technology methods.

32. The heating element as claimed in claim 10, wherein:

said at least one essentially electrically insulating separating layer is manufactured of glass.

33. The heating element as claimed in claim 12, wherein:

said conductive material is platinum.

34. The heating element as claimed in claim 13, wherein:

said noble metal is silver; and said noble metal alloy is silver alloy.

35. The heating element as claimed in claim 14, wherein:

said noble metal is gold with a purity of at least greater than 95%.

36. The heating element as claimed in claim 21, wherein;

said PTC resistive structure is made of platinum.

37. The hearing element as claimed in claim 22, wherein:

said connecting lines are made of gold.

38. The heating element as claimed in claim 23, wherein:

said connecting contacts are made of silver.

* * * * *